US005901429A

United States Patent [19]

Crockett

[11] Patent Number: 5,901,429

[45] Date of Patent: May 11, 1999

[54] METHOD OF MANUFACTURING COMPOSITE PANCAKE SLIP RING ASSEMBLY

[75] Inventor: Russell L. Crockett, Christiansburg, Va.

[73] Assignee: Litton Systems, Inc., Woodland Hills, Calif.

[21] Appl. No.: 08/887,697

[22] Filed: Jul. 3, 1997

[51] Int. Cl.[6] ..... H01R 43/06

[52] U.S. Cl. ..... 29/597

[58] Field of Search ..... 29/597, 596, 598; 310/232, 235

[56] References Cited

U.S. PATENT DOCUMENTS 4,510,276 4/1985 Leech et al. ..... 523/427

5,734,218 3/1998 Crockett et al. ..... 310/232

*Primary Examiner*—Timothy V. Eley

*Assistant Examiner*—Benjamin M. Halpern

*Attorney, Agent, or Firm*—Gerald L. Lett; Scott J. Coonan; Michael H. Wallach

[57] ABSTRACT

A method of manufacturing a flat, composite ("pancake") slip ring is described. An assembly of slip rings of conductive material are formed by photo etching or the like into a plurality of annular, concentric conductive rings, the inner and outer diameters of the rings being connected by alignment tabs. A surface of the rings may be masked prior to plating a precious metal on the opposing surface. The slip ring assembly is aligned with the base and bonded to it prior to removing the alignment tabs.

24 Claims, 3 Drawing Sheets

METHOD OF MANUFACTURING COMPOSITE PANCAKE SLIP RING ASSEMBLY

BACKGROUND OF THE INVENTION

This invention relates to a method of manufacturing an electrical slip ring assembly. More particularly, the method relates to a manner of constructing a flat or "pancake" slip ring assembly.

Electrical slip rings are well known devices for communicating electrical signals from one structural member to another where one of the structural members is rotatable with respect to the other. Such a slip ring assembly, for example, may comprise a relatively stationary annular base member which has a plurality of conductive rings extending annually therearound. One or more electrically conductive brushes are arranged on a relatively rotatable structural member to rotate about the slip ring base and each of the brushes is arranged to contact a surface of one of the conductive rings thereby forming a series of electrical connections between the two structural members.

The flat or "pancake" slip ring is such a device of minimal height or thickness for military or commercial environments where space for the slip ring is very limited. The conductive rings forming the slip ring base generally are formed from materials having a thickness of from 0.003 to 0.040 inches with most such materials having a thickness in the range of 0.006 to 0.016 inches. Characteristically, the rings for such a slip ring base are approximately 0.015 to 0.020 inches in width. The spaces between the rings, or the ring pitch are characteristically approximately of the same dimension.

It can be seen that in order to manufacture slip ring assemblies of such size and structure severe manufacturing difficulties will be experienced. These will produce higher manufacturing, including tooling costs.

In a variety of applications slip rings of these dimensions are needed, but heretofore, it has not been possible to produce such slip ring assemblies cost effectively in volume.

The method of the invention seeks to provide a technique for manufacturing such slip rings with little waste and relatively low manufacturing cost.

SUMMARY OF THE INVENTION

In accordance with the principles of the invention, flat or "pancake" slip rings are manufactured by initially producing a conductive slip ring made up of a plurality of annular, concentric conductive rings having dimensions such as those discussed hereinabove, using photo etching techniques or the like. These slip rings have the individual concentric rings removably connected one to the other by alignment tabs to maintain the proper dimensional alignment during assembly. These tabs are formed, as well, in the photo etching or similar process. As necessary, one surface of the slip ring assembly may be masked to allow plating the other surface of the ring with a precious metal. Means are provided for aligning the slip ring assembly with a substrate or base of a relatively nonconductive material, such as an insulating base or a circuit board substrate. After the slip ring assembly is bonded to the base, the aforementioned aligning tabs are removed.

DETAILED DESCRIPTION OF THE DRAWINGS

Figure 1:
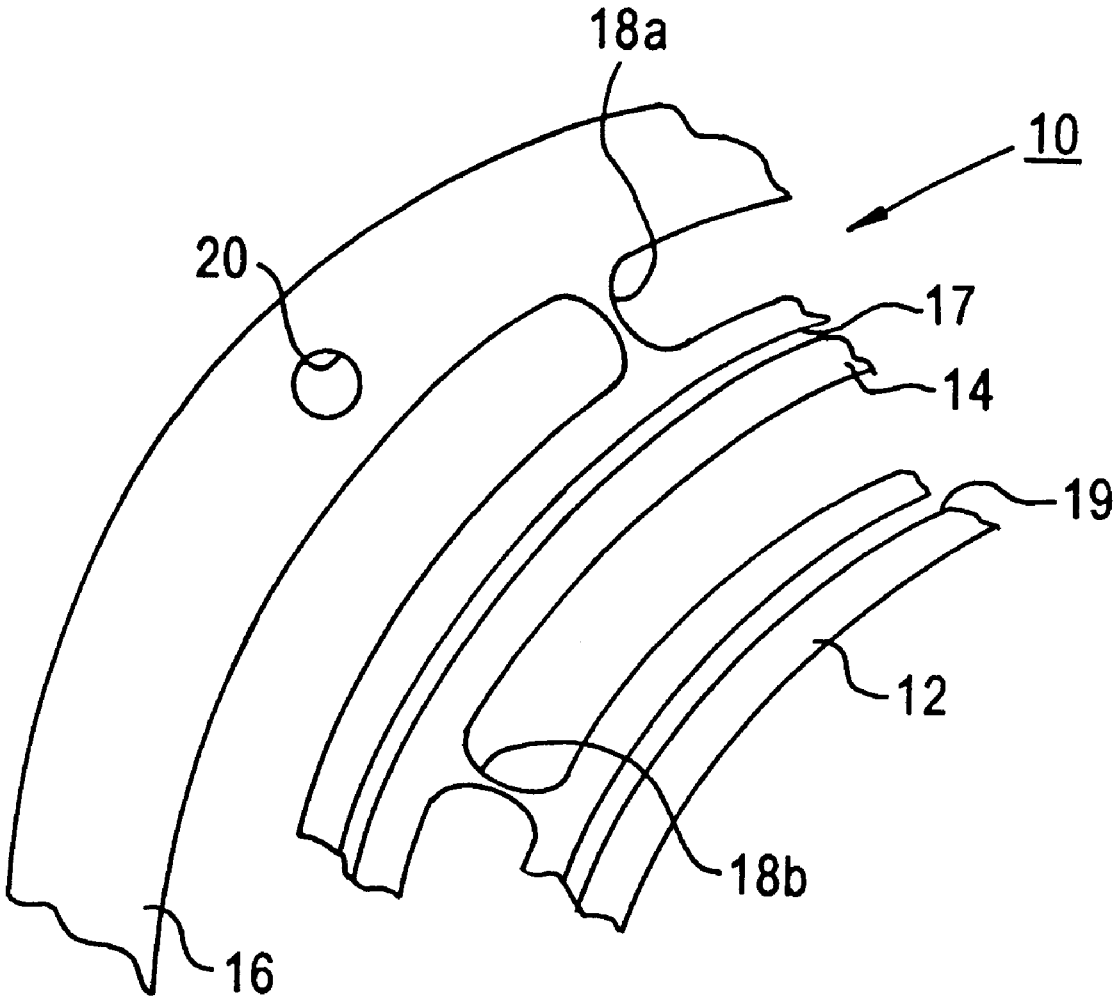
FIG. 1 is a partial, cutaway perspective view of the conductive slip ring assembly according to the invention having a plurality of annular, concentric conductive rings and an annular, concentric alignment ring.

FIG. 1 is a cutaway partial perspective view of a slip ring assembly according to the invention having a plurality of concentric, annular rings as illustrated by the conductive rings 12 and 14. A larger number of such conductive rings are likely to be used. In addition, this slip ring assembly embodiment includes an alignment ring 16 having a plurality of a alignment holes 20 (only one is such hole is shown in this view).

Such a slip ring assembly is generally made of a conductive material such as copper and its alloys and is generally formed by using photo etching, stamping, coining, fine blanking and like techniques.

In addition, grooves such as those shown at 17 and 19 are formed in the individual conducting rings. These grooves have predetermined widths and depths in accordance with the dimensions of the brushes with which the slip ring assembly is to be used. These dimensions are characteristically a function of the desired current carrying capacity.

The photo etching or like techniques used to manufacture slip ring assemblies such as the one shown in FIG. 1 yield special alignment requirements when mating the slip ring assemblies with a substrate base. To address this problem, in the FIG. 1 embodiment an additional alignment ring 16 is shown having alignment holes 20 formed therein. In this embodiment although only one such hole is shown, it is contemplated that there be 3 holes placed 120 degrees apart on the circumference of this alignment ring. These alignment holes can be appropriately aligned with similar such holes on the substrate base on which the photo etched ring assembly is to be mounted.

As will be shown in the following, the formed or etched slip rings are contemplated to be assembled to a base in one of two primary ways to form the composite slip ring assembly. They may be cemented to a molded, cast formed or machined insulating base by using a thin amount of adhesive. This type of base has a cavity below the base's surface for adhering the slip ring to the base. The base has holes or slots directly under the surface of each ring. These holes are used to solder or weld a lead wire to the ring's under side.

Secondly, it is contemplated that such slip ring assemblies might be adhered to a base which is essentially a printed circuit board. This base can consist of an insulating disk with annular rings of a conductive material located on a side thereof. These annular conductive rings are equipped with plated through holes that connect to a circuit on the underside of the base. These mounting techniques are described in greater detail herein below.

Figure 2C:
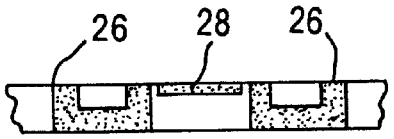
FIG. 2A is an exploded, side cross-sectional view illustrating utilization of the method according to the invention to assemble a slip ring assembly according to the invention on an insulating base.
FIG. 2B is a magnified view of a segment of the slip ring portion of the FIG. 2A embodiment.
Figure 2A:
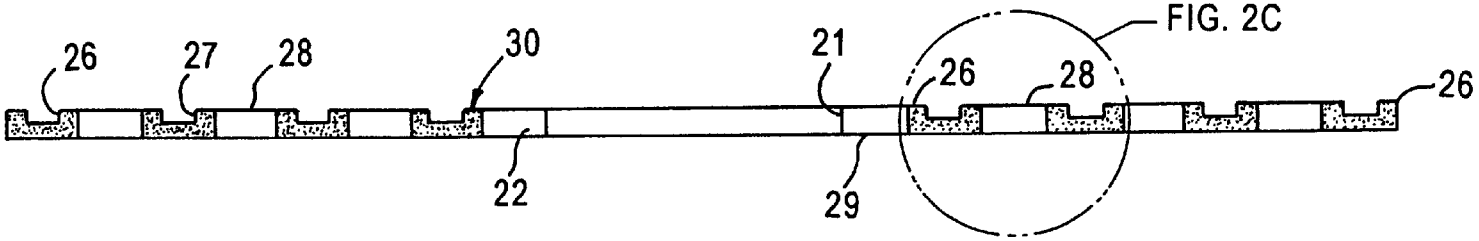
Figure 2B:
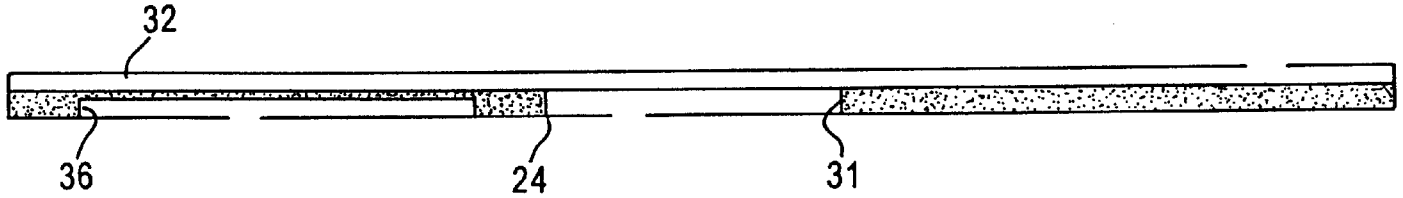

FIG. 2A is a side cross sectional exploded view illustrating an etched, or otherwise formed, assembly of conductive slip rings 22 and an insulating base 24. The illustrated assembly of slip rings 22 includes a plurality of annular, concentric rings 26 extending radially outwardly from a through bore 21. The respective annular rings 26, at this stage of the assembly, are connected one to the other by alignment tabs 28 spaced around the circumference of the rings and connecting an outer diameter of one ring to the inner diameter of the next radially outward ring.

Annular grooves 27 are formed in each of the rings 26. Each of the rings is overplated with silver, gold, nickel or other precious metal which will serve to decrease electrical noise and wear of the ring and the brush (not shown).

Insulating base 24 to which the slip ring assembly 22 is to be assembled is of a plastic, or other insulating material. As shown, it has a cavity 32 for receiving the etched slip ring assembly and appropriate cement. A through hole 31 designed to cooperate with through hole 21 provides for shaft mounting of the completed flat slip ring assembly. A cavity 36 is provided on the underside of base 24 to provide space for electrical leads to external circuitry and potting for those leads. Although not shown, these leads are connected to the individual annular rings 26 through holes in the insulating base.

Prior to assembly, a photo mask is applied to the underside 29 of slip ring assembly 22, and the opposite exposed side of the slip ring assembly is overplated with the above mentioned precious metal. The photo masking can them be chemically removed after plating. At this time, the underside surface 29 is prepared for attaching to insulating base 24.

If alignment holes, such as those shown in FIG. 1 are present, these can be used to align the slip ring assembly 22 with the base 24 using a mandrel or the like. When slip ring assembly 22 is located over the base and adhesive is applied and the slip ring assembly 22 and base 24 are bonded to form a completed, composite pancake slip ring assembly. After assembly of the slip ring assembly 22 and base 24, the connecting tabs 28 are removed as is the alignment ring 16.

Figure 3C:
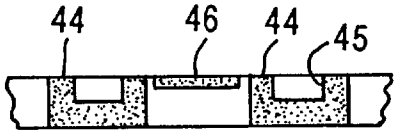
FIG. 3A is an exploded, side cross-sectional view illustrating the utilization of the method according to the invention to assemble a flat slip ring on a circuit board base.
FIG. 3B is a magnified partial view of the slip ring assembly portion of FIG. 3A.
Figure 3A:
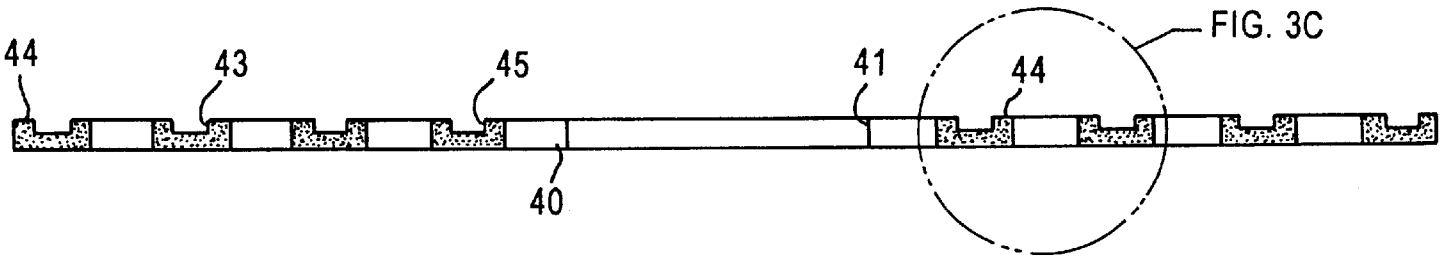
Figure 3B:
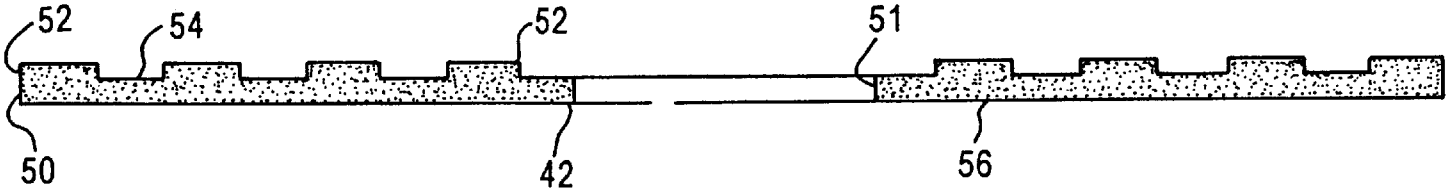

FIGS. 3A and 3B illustrate a second primary form of assembly of such a flat slip ring. In this case an assembly of conductive slip rings 40 is adhered to a printed circuit board-type base 42. In this embodiment the series of annular, concentric conductive rings 44 are similarly formed by photo etching or the like. The assembly also includes a series of alignment tabs 46 mechanically connecting, respectively, the outer and inner diameters of radially adjacent rings 44. A through bore 41 is provided for mounting on a rotating shaft or the like.

As above, the rings 44 each have an annular groove 43 formed therein for receiving a mating conductive brush (not shown). Also, as above, each annular ring 44 is likely to be plated with a precious metal for the reasons discussed above.

The base 42 is formed as an annular disk of an insulating material, such as a plastic. A series of annular rings 52 of a conductive material are formed on the upper surface 54 of base 42. Although not shown, a series of plated through holes extend from the base rings 52 to openings in the underside 56 of the printed circuit board base 42 which are connected to circuit traces.

For assembly, the surfaces of base rings 52 are coated with a thin tin plating or a thin film of solder paste. The slip rings 44 are located on top of the solder paste and aligned by alignment ring 16, as desired, on the base member 42. Using this manner of assembly, the assembled components are passed through a heat source and press for permanent bonding to form the complete composite pancake slip ring assembly. After mounting, the connecting or alignment tabs 46 and alignment ring 16 are removed.

The techniques described hereinabove can be used with a wide variety of configurations of flat slip ring assemblies. These might include an etched slip ring located with an etched optical encoded disk to include a combination pancake slip ring and encoder ring. Moreover, it is contemplated that the method described herein can be used when it is determined that alignment tabs or rings are not needed.

It is to be understood that the described embodiments can be modified or changed in the number of ways known to those skilled in the art while remaining within the scope of the invention as defined in the appended claims.

I claim:

1. A method of manufacturing a flat composite slip ring having an assembly of conductive slip rings and a base, comprising the steps of:

forming a conductive slip ring assembly having a plurality of radially spaced annular, concentric conductive rings, each having an inner and outer diameter, the inner and outer diameters, respectively, of adjacent rings being connected by removable alignment tabs, masking a first surface of said slip ring assembly, said first surface being the surface to be adhered to said base, plating a second surface of said slip ring with a conductive material and thereafter removing said masking from said first surface, aligning said slip ring assembly with said base, adhering said slip ring assembly to said base and removing said alignment tabs.

2. The method defined in claim 1 wherein said second surface of said assembly of annular rings has annular grooves formed therein during said forming step.

3. The method defined in claim 1 wherein said plating material is one of gold, silver or nickel.

4. The method defined in claim 1 wherein said aligning step comprises aligning the base having annularly concentric conductive rings formed on an insulating surface, which rings are aligned with said annular rings of said slip ring assembly.

5. The method defined in claim 1 wherein said aligning step comprises aligning said slip ring assembly of annular rings on a proportionally sized insulating base.

6. A method of manufacturing a flat, composite slip ring having an assembly of conductive slip rings mounted on a circuit board and connectable to external circuitry comprising the steps of:

forming a circuit board from an insulating material and adhering to a first side thereof a plurality of annular, concentric base rings of conductive material, extending a series of plated-through holes from selected locations on said base rings through said circuit board to a second side thereof forming connection points to external circuitry, forming a conductive slip ring assembly made up of a plurality of annular, concentric conductive rings and conductively adhering said slip ring assembly to said base rings on said circuit board.

7. The method defined in claim 6 wherein said slip rings are formed to have annular grooves therein for receiving a slip ring brush.

8. The method defined in claim 6 wherein each of said slip rings has an inner an outer diameter, wherein said slip ring assembly is formed to have a plurality of alignment tabs connecting, respectively, the adjacent inner and outer diameters of adjacent slip rings, said alignment tabs being removable.

9. The method defined in claim 6 comprising the additional steps of:

bonding said slip rings to said base rings with a conductive adhesive material, pressing the slip rings on said base rings and passing the assembled slip rings and base rings through a heat source.

10. The method of claim 1, wherein said base has a flat surface and said slip ring assembly is adhered to said flat surface.

11. The method of claim 1, wherein said plurality of radially spaced annular, concentric conductive rings are formed in a plane and said removable alignment tabs are located in the plane.

12. The method of claim 1, further comprising forming an alignment ring and connecting the alignment ring to one of the plurality of conductive rings.

13. The method of claim 12, wherein the alignment ring has alignment holes.

14. The method of claim 1, wherein the adhering is by cement.

15. A method of manufacturing a flat composite slip ring, comprising:

forming a conductive slip ring assembly having a first conductive ring and a second conductive ring, the first and second being radially spaced;

connecting the first and the second conductive rings with removable alignment tabs;

aligning the conductive slip ring with a base; and joining the conductive slip ring to the base.

16. The method of claim 15, comprising forming annular grooves in each of the first and second conductive rings.

17. The method of claim 15, further comprising plating a portion of said composite slip ring with plating material, wherein said plating material is one of gold, silver or nickel.

18. The method of claim 15, wherein said aligning step comprises aligning a base having annularly concentric conductive rings formed on an insulating surface, which rings are aligned with said annular rings of said slip ring assembly.

19. The method of claim 15, wherein said base has a flat surface and said slip ring assembly is adhered to said flat surface.

20. The method of claim 15, wherein the first and the second conductive rings are formed in a plane and the removable alignment tabs are located in the plane.

21. The method of claim 15, further comprising forming an alignment ring and connecting the alignment ring to one of the plurality of conductive rings.

22. The method of claim 15, wherein the alignment ring has alignment holes.

23. The method of claim 15, wherein the adhering is by cement.

24. The method of claim 15, further comprising removing the alignment tabs.

* * * * *